US010714237B1

(12) United States Patent
Hamner et al.

(10) Patent No.: US 10,714,237 B1
(45) Date of Patent: Jul. 14, 2020

(54) ELECTRICAL CONNECTOR ASSEMBLY HAVING DIFFERENTIAL PAIR CABLE ASSEMBLY

(71) Applicant: TE CONNECTIVITY CORPORATION, Berwyn, PA (US)

(72) Inventors: Richard Elof Hamner, Hummelstown, PA (US); Christopher William Blackburn, Bothell, WA (US); Christopher David Ritter, Hummelstown, PA (US)

(73) Assignee: TE CONNECTIVITY CORPORATIOn, Berwyn, PA (US)

( * ) Notice: Subject to any disclaimer, the term of this patent is extended or adjusted under 35 U.S.C. 154(b) by 0 days.

(21) Appl. No.: 16/274,702

(22) Filed: Feb. 13, 2019

(51) Int. Cl.

| | |
|---|---|
| ***H01B 11/00*** | (2006.01) |
| ***H01R 12/70*** | (2011.01) |
| ***H01B 11/02*** | (2006.01) |
| ***H01R 9/03*** | (2006.01) |
| ***H01R 13/6593*** | (2011.01) |
| ***H01R 12/71*** | (2011.01) |
| ***H01R 12/72*** | (2011.01) |
| ***H01R 13/405*** | (2006.01) |

(52) U.S. Cl.
CPC ..... *H01B 11/002* (2013.01); *H01B 11/02* (2013.01); *H01R 9/03* (2013.01); *H01R 12/7005* (2013.01); *H01R 12/716* (2013.01); *H01R 12/721* (2013.01); *H01R 13/405* (2013.01); *H01R 13/6593* (2013.01)

(58) Field of Classification Search
CPC ..... H01R 12/75; H01R 9/035; H01R 9/034; H01R 9/037; H01R 9/038; H01B 11/002
See application file for complete search history.

(56) References Cited

U.S. PATENT DOCUMENTS

| | | | | |
|---|---|---|---|---|
| 7,906,730 | B2 | 3/2011 | Atkinson et al. | |
| 8,449,329 | B1 * | 5/2013 | Schroll | H01R 13/6586 439/607.05 |
| 9,011,177 | B2 | 4/2015 | Lloyd et al. | |
| 9,553,381 | B2 * | 1/2017 | Regnier | H01R 13/6473 |
| 9,748,703 | B2 | 8/2017 | Keyser et al. | |
| 2018/0034175 | A1 | 2/2018 | Lloyd et al. | |

* cited by examiner

*Primary Examiner* — Ross N Gushi

(57) ABSTRACT

A differential pair cable assembly includes a cable having a twin axial cable core including first and second conductors conveying differential signals and a cable shield. The cable assembly includes first and second contacts and a housing holding the first and second contacts. The cable assembly includes a shield having a shield cavity that receives the housing and the end of the cable and is electrically connected to the cable shield. The shield provides electrical shielding for the first and second contacts. The shield, the housing, and the contacts define a mating interface of the cable assembly configured to be mated to a mating component.

23 Claims, 11 Drawing Sheets

ELECTRICAL CONNECTOR ASSEMBLY HAVING DIFFERENTIAL PAIR CABLE ASSEMBLY

BACKGROUND OF THE INVENTION

The subject matter herein relates generally to electrical connector assemblies having differential pair cable assemblies.

Electrical connector systems typically include electrical connectors that are electrically connected by a circuit board. For example, circuit traces of the circuit board are used to electrically connect the electrical connectors. However, long signal paths defined by the electrical traces routed through the circuit board lead to performance loss due to signal degradation along the electrical traces. Additionally, some systems have many signal paths, leading to many circuit traces and multiple layers in the circuit board, which adds complexity and cost to the electrical connector system.

A need remains for an electrical connector system having reliable signal performance.

BRIEF DESCRIPTION OF THE INVENTION

In one embodiment, a differential pair cable assembly is provided including a differential pair cable having a twin axial cable core including a first conductor and a second conductor arranged within a cable jacket. The cable core includes a cable shield providing electrical shielding for the first conductor and the second conductor. The first and second conductors are a differential pair conveying differential signals. The differential pair cable assembly includes a first contact terminated to the first conductor and a second contact terminated to the second conductor. The differential pair cable assembly includes a differential pair housing holding the first contact and the second contact and being coupled to an end of the differential pair cable. The differential pair cable assembly includes a differential pair shield having a shield cavity. The differential pair shield receives the differential pair housing and the end of the differential pair cable and is electrically connected to the cable shield. The differential pair shield provides electrical shielding for the first contact and the second contact. The differential pair shield, the differential pair housing, the first contact, and the second contact defining a mating interface of the differential pair cable assembly configured to be mated to a mating component.

In another embodiment, a differential pair cable assembly is provided including a differential pair cable having a twin axial cable core including a first conductor and a second conductor arranged within a cable jacket. The cable core includes a cable shield providing electrical shielding for the first conductor and the second conductor. The first and second conductors are a differential pair conveying differential signals. The differential pair cable assembly includes a first contact having a first mating end and a first terminating end terminated to the first conductor. The first mating end includes a board mating interface configured to be mated directly to a mating circuit board. The differential pair cable assembly includes a second contact having a second mating end and a second terminating end terminated to the second conductor. The second mating end includes a board mating interface configured to be mated directly to the mating circuit board. The differential pair cable assembly includes a differential pair housing holding the first contact and the second contact. The differential pair housing is coupled to an end of the differential pair cable. The differential pair cable assembly includes a differential pair shield having a shield cavity. The differential pair shield receives the differential pair housing in the shield cavity. The differential pair shield receives the end of the differential pair cable and is electrically connected to the cable shield. The differential pair shield provides electrical shielding for the first contact and the second contact. The differential pair shield has a shield contact configured to be mated directly to the mating circuit board to electrically ground the differential pair shield.

In a further embodiment, an electrical connector assembly is provided including a connector housing having a mating end configured to be mated to a mating electrical connector and a cable contact module received in the connector housing. The cable contact module has a first mating contact and a second mating contact at the mating end for mating with the mating electrical connector. The electrical connector assembly includes a differential pair cable assembly extending from the cable contact module. The differential pair cable assembly includes a differential pair cable having a twin axial cable core including a first conductor and a second conductor arranged within a cable jacket. The first conductor is electrically connected to the first mating contact and the second conductor is electrically connected to the second mating contact. The cable core includes a cable shield providing electrical shielding for the first conductor and the second conductor. The first and second conductors are a differential pair conveying differential signals. The differential pair cable assembly includes a first contact terminated to the first conductor opposite the first mating contact and a second contact terminated to the second conductor opposite the second mating contact. The differential pair cable assembly includes a differential pair housing holding the first contact and the second contact. The differential pair housing is coupled to an end of the differential pair cable. The differential pair cable assembly includes a differential pair shield having a shield cavity. The differential pair shield receives the differential pair housing in the shield cavity. The differential pair shield receives the end of the differential pair cable and is electrically connected to the cable shield. The differential pair shield provides electrical shielding for the first contact and the second contact. The differential pair shield, the differential pair housing, the first contact, and the second contact define a mating interface of the differential pair cable assembly spaced apart from the cable contact module and configured to be mated to a mating component.

In another embodiment, an electrical connector assembly is provided including a connector housing having a mating end configured to be mated to a mating electrical connector. The electrical connector assembly includes a board contact module and a cable contact module received in the connector housing. The board contact module has first and second contacts having mating ends at the mating end of the connector housing for mating with the mating electrical connector and terminating ends opposite the mating ends configured to be directly terminated to a circuit board. The cable contact module has a first mating contact and a second mating contact at the mating end for mating with the mating electrical connector. The electrical connector assembly includes a differential pair cable assembly extending from the cable contact module. The differential pair cable assembly includes a differential pair cable having a twin axial cable core including a first conductor and a second conductor arranged within a cable jacket. The first conductor is electrically connected to the first mating contact and the second conductor is electrically connected to the second mating contact. The cable core includes a cable shield providing electrical shielding for the first conductor and the second conductor. The first and second conductors are a differential pair conveying differential signals. The differential pair cable assembly includes a first contact terminated to the first conductor opposite the first mating contact and a second contact terminated to the second conductor opposite the second mating contact. The differential pair cable assembly includes a differential pair housing holding the first contact and the second contact. The differential pair housing is coupled to an end of the differential pair cable. The differential pair cable assembly includes a differential pair shield having a shield cavity. The differential pair shield receives the differential pair housing in the shield cavity. The differential pair shield receives the end of the differential pair cable and is electrically connected to the cable shield. The differential pair shield provides electrical shielding for the first contact and the second contact. The differential pair shield, the differential pair housing, the first contact, and the second contact define a mating interface of the differential pair cable assembly spaced apart from the cable contact module and configured to be mated to a mating component.

DETAILED DESCRIPTION OF THE INVENTION

Figure 1:
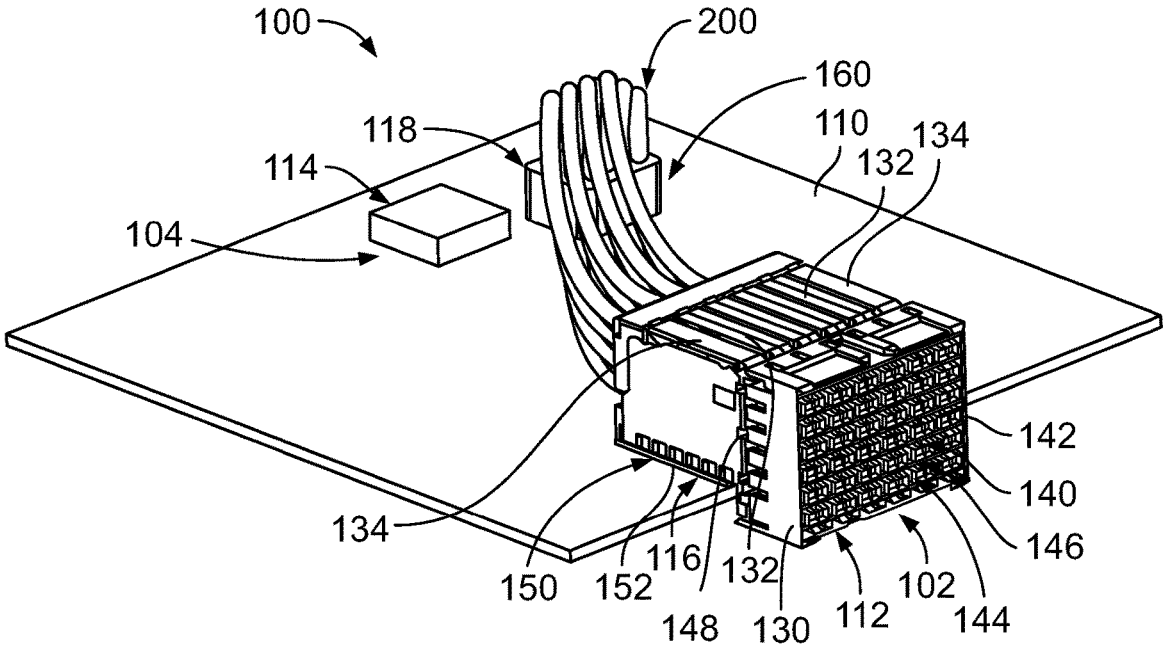
FIG. 1 is a front perspective view of an electrical connector system in accordance with an exemplary embodiment.
Figure 2:
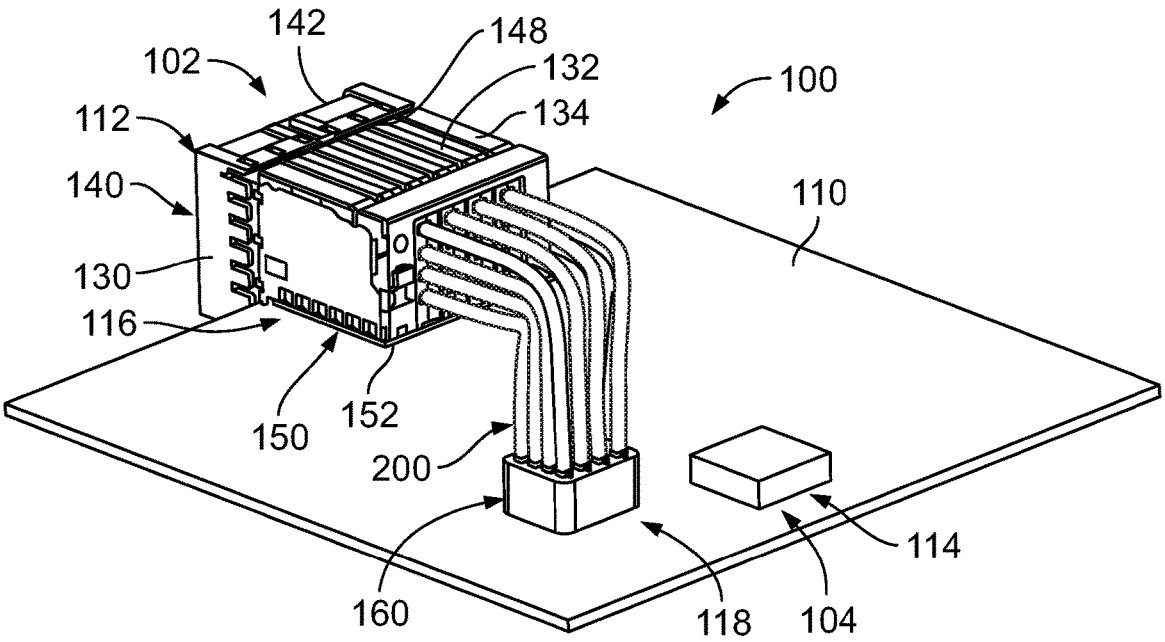
FIG. 2 is a rear perspective view of the electrical connector system in accordance with an exemplary embodiment.

FIG. 1 is a front perspective view of an electrical connector system 100 in accordance with an exemplary embodiment. FIG. 2 is a rear perspective view of the electrical connector system 100 in accordance with an exemplary embodiment. The electrical connector system 100 includes a plurality of differential pair cable assemblies 200 that are used to electrically connect a first electrical component 102 with a second electrical component 104. The differential pair cable assemblies 200 convey differential signals between the first and second electrical components 102, 104 through cables rather than through traces of a circuit board. The differential pair cable assemblies 200 allow longer signal paths and/or less signal degradation along the signal paths between the first and second electrical components 102, 104. The differential pair cable assemblies 200 may be used for high speed electrical signaling through the electrical connector system 100.

In various embodiments, the electrical connector system 100 includes a circuit board 110. In an exemplary embodiment, the first electrical component 102 includes a first electrical connector assembly 112 and the second electrical component 104 includes a second electrical connector assembly 114 (shown schematically in FIGS. 1 and 2). The second electrical connector assembly 114 is remote from and spaced apart from the first electrical connector assembly 112. The second electrical connector assembly 114 may be a receptacle connector, a plug connector, or another type of electrical connector in various embodiments. In other various embodiments, the second electrical component 104 may be an IC component or other type of component rather than or in addition to an electrical connector. The circuit board 110 may define a portion of the second electrical component 104. In the illustrated embodiment, both electrical connector assemblies 112, 114 are mounted to the circuit board 110 at remote locations, such as a first location 116 and a second location 118. However, in alternative embodiments, the first electrical connector assembly 112 and/or the second electrical connector assembly 114 may be mounted to a different circuit board.

The differential pair cable assemblies 200 are used to electrically connect the electrical connector assemblies 112, 114. In various embodiments, the differential pair cable assemblies 200 may be directly terminated to the electrical connector assembly 112 and/or the electrical connector assembly 114. In other various embodiments, the differential pair cable assemblies 200 may be terminated to the circuit board 110 proximate to the electrical connector assembly 112 and/or the electrical connector assembly 114. In such embodiments, a majority of the signal paths are defined by the cables of the differential pair cable assemblies 200, while relatively short signal paths are defined by conductors of the circuit board 110, such as traces of the circuit board 110.

The electrical connector assembly 112 includes a connector housing 130 holding a plurality of contact modules in a contact module stack at a rear of the connector housing 130. In the illustrated embodiment, the electrical connector assembly 112 includes cable contact modules 132 and board contact modules 134. The differential pair cable assemblies 200 are directly terminated to corresponding cable contact modules 132. Electrical signals of the cable contact modules 132 are routed through the differential pair cable assemblies 200 to the second location 118 remote from the electrical connector assembly 112. The board contact modules 134 are directly terminated to the circuit board 110. Electrical signals of the board contact modules 134 are routed into the circuit board 110 and may be routed through or along the circuit board 110 to another electrical component.

The connector housing 130 includes a mating interface 140 at a front 142 of the connector housing 130. The connector housing 130 includes signal contact openings 144 at the front 142 and ground contact openings 146 at the front 142. The signal contact openings 144 receive mating signal contacts of a mating connector, such as a header connector, when the electrical connector assembly 112 is mated thereto. The ground contact openings 146 receive mating ground contacts of the mating connector when mated thereto. In the illustrated embodiment, the electrical connector assembly 112 is a receptacle connector assembly configured to be mated with a header connector assembly. Other types of electrical connector assemblies may be provided in alternative embodiments.

The contact modules 132, 134 extend from a rear 148 of the connector housing 130. The contact modules 132, 134 have mounting ends 150 configured to be mounted to the circuit board 110. In the illustrated embodiment, the mounting ends 150 are provided at a bottom 152 of the contact modules 132, 134. Other orientations are possible in alternative embodiments. In other various embodiments, the contact modules 132 are mounted to another structure other than the circuit board 110. The contact modules 132, 134 include signal contacts and ground contacts received in the signal contact openings 144 and the ground contact openings 146 for mating with the mating connector. The signal contacts and the ground contacts of the board contact modules 134 having terminating ends, such as compliant pins, eye-of-the-needle pins, solder tails, and the like, which are terminated directly to the circuit board 110. The signal contacts and the ground contacts of the cable contact modules 132 are terminated to the differential pair cable assemblies 200. The signal contacts of the contact modules 132, 134 have mating ends, such as spring beams, pins, sockets, and the like, which are configured to be mated with the mating electrical connector.

In the illustrated embodiment, the differential pair cable assemblies 200 are terminated directly to the circuit board 110 at the second location 118. In an exemplary embodiment, the electrical connector system 100 includes a holder 160 that holds a plurality of the differential pair cable assemblies 200 together for mating to the circuit board 110. For example, the holder 160 includes an overmolded body overmolded around ends of the differential pair cable assemblies 200 to physically hold relative positions of the differential pair cable assemblies 200 for mounting to the circuit board 110. In other various embodiments, the ends of the differential pair cable assemblies 200 may be individually mounted to the circuit board 110, rather than being held together by the holder 160. The holders 160 may form portions of the contact modules 132, 134. In other various embodiments, rather than directly terminating the differential pair cable assemblies 200 to the circuit board 110, the differential pair cable assemblies 200 may be mated with a mating electrical component terminated to the circuit board 110 such as a header assembly or a receptacle assembly that receives the end of the differential pair cable assembly 200.

Figure 3:
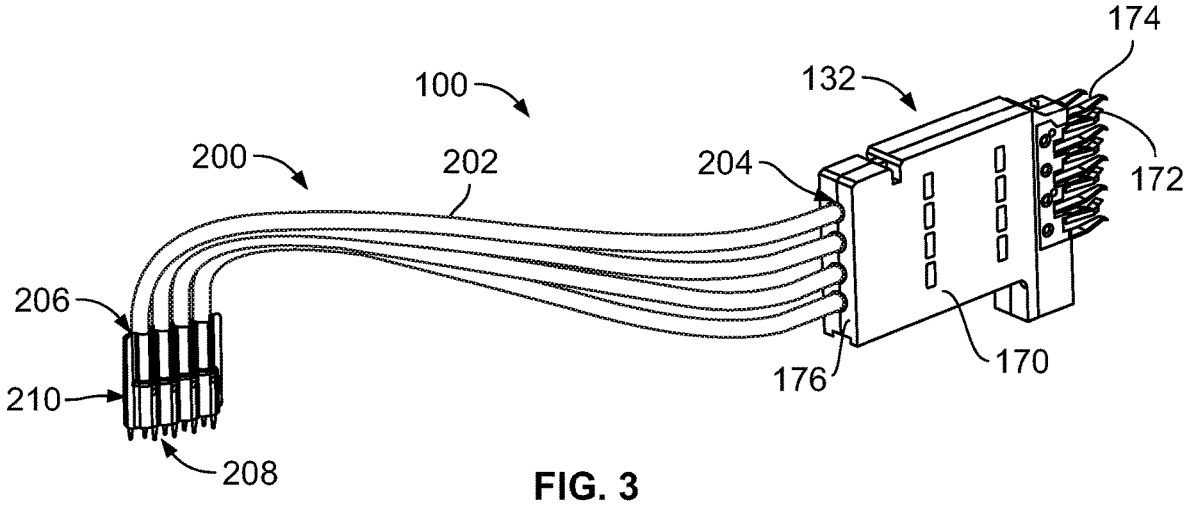
FIG. 3 is a rear perspective view of a portion of the electrical connector system in accordance with an exemplary embodiment.

FIG. 3 is a rear perspective view of a portion of the electrical connector system 100 in accordance with an exemplary embodiment showing one of the cable contact modules 132 and the plurality of the differential pair cable assemblies 200 extending therefrom. Each differential pair cable assembly 200 includes a differential pair cable 202 extending between a first end 204 and a second end 206. The first end 204 extends from the cable contact module 132. In other various embodiments, the first end 204 may be terminated to another electrical component, such as directly to the circuit board 110 or to another electrical component at a separable interface. Each differential pair cable assembly 200 includes a mating interface 208 at the second end 206 configured to be mated with an electrical component, such as directly to the circuit board 110. In an exemplary embodiment, each differential pair cable assembly 200 includes a cable connector 210 at the second end 206 defining the mating interface 208. The cable connector 210 is configured to be electrically connected to the corresponding electrical component 104 (shown in FIG. 1), such as directly to the circuit board 110 or through another connector on the circuit board 110. In other various embodiments, the second end 206, such as the cable connector 210, may be terminated to another electrical component, such as to a cable contact module or to another electrical component at a separable interface.

The cable contact module 132 includes a frame 170 holding signal contacts 172 and ground contacts 174. The signal contacts 172 and the ground contacts 174 are configured to be loaded into the connector housing 130 (shown in FIG. 1) for mating with the mating electrical component. In various embodiments, the frame 170 may be dielectric, such as plastic, to hold the signal contacts 172. Optionally, a portion of the frame 170 may be conductive to provide electrical shielding for the signal contacts 172. For example, a separate shield may be attached to one or both sides of the frame 170. In other various embodiments, the frame 170 may be a metallized on the exterior surface thereof. The differential pair cables 202 extend from a rear 176 of the frame 170; however, the differential pair cables 202 may extend from other portions of the frame 170 and alternative embodiments.

Figure 4:
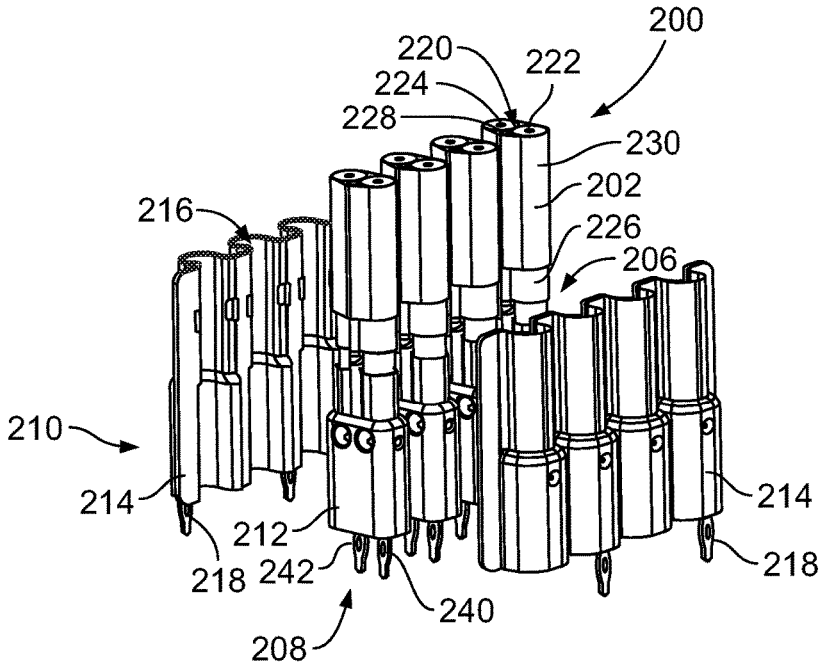
FIG. 4 is a partially exploded perspective view of the ends of a plurality of differential pair cable assemblies of the electrical connector system in accordance with an exemplary embodiment.

FIG. 4 is a partially exploded, perspective view of the ends of a plurality of the differential pair cable assemblies 200. FIG. 4 illustrates the cable connectors 210 of the differential pair cable assemblies 200 in accordance with an exemplary embodiment. In an exemplary embodiment, each differential pair cable assembly 200 includes a differential pair housing 212 at the end 206 of the differential pair cable 202. Each cable connector 210 includes differential pair shields 214 having shield cavities 216 that receive the differential pair housings 212. The differential pair shields 214 are provided at the ends 206 of the differential pair cables 202. Optionally, the differential pair shields 214 may include one or more shield contacts 218 at the mating interface 208 configured to be electrically connected to the mating electrical component 104. For example, the shield contacts 218 may be compliant pins configured to be press-fit into plated vias of the circuit board 110. Other types of shield contacts may be provided in alternative embodiments.

The differential pair cable 202 includes a twin-axial cable core 220 having a first conductor 222 and a second conductor 224. The cable core 220 includes a cable shield 226 providing electrical shielding for the first conductor 222 and the second conductor 224. Both the conductors 222, 224 are located inside the cable shield 226. The cable shield 226 may be a conductive foil, a conductive tape, a conductive wrap, or another conductive layer surrounding the first and second conductors 222, 224. The conductors 222, 224 are arranged within insulators that electrically isolate the cable shield 226 from the conductors 222, 224. The conductors 222, 224 are a differential pair configured to convey differential signals. In an exemplary embodiment, the cable core 220 includes a drain wire 228 extending along the cable shield 226. The drain wire 228 may extend along the exterior of the cable shield 226. Alternatively, the drain wire 228 may extend along an interior of the cable shield 226. A cable jacket 230 surrounds the cable core 220. The cable jacket 230 surrounds the drain wire 228 and the cable shield 226.

In an exemplary embodiment, each differential pair cable assembly 200 includes a first contact 240 and a second contact 242. The contacts 240, 242 define a differential pair of contacts at the mating interface 208 configured to be electrically connected to the mating electrical component 104. The first contact 240 is configured to be terminated to the first conductor 222. The second contact 242 is configured to be terminated to the second conductor 224. In various embodiments, the contacts 240, 242 may include compliant pins at the mating interface 208 configured to be press-fit into plated vias of the circuit board 110. Other types of contacts may be provided in alternative embodiments, such as pin contacts, socket contacts, deflectable spring beam contacts, and the like.

Figure 5:
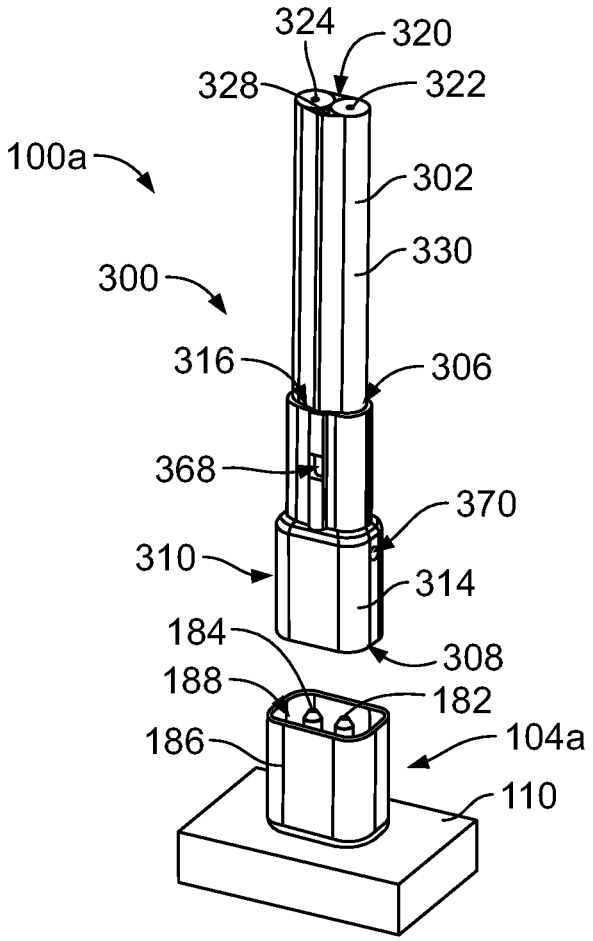
FIG. 5 is a partially exploded perspective view of a portion of the electrical connector system in accordance with an exemplary embodiment.
Figure 6:
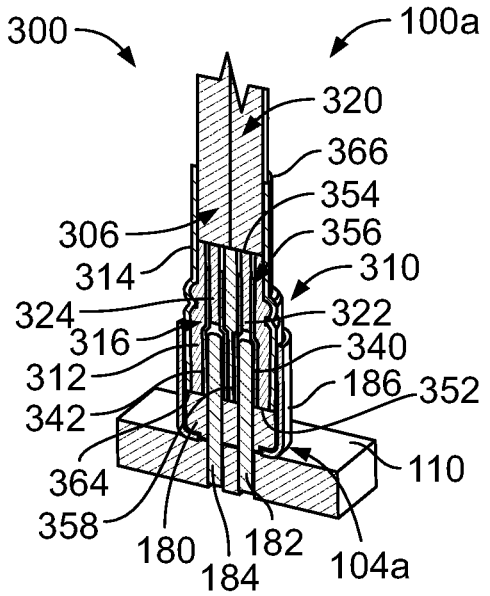
FIG. 6 is a cross-sectional perspective view of a portion of the electrical connector system in accordance with an exemplary embodiment.
Figure 7:
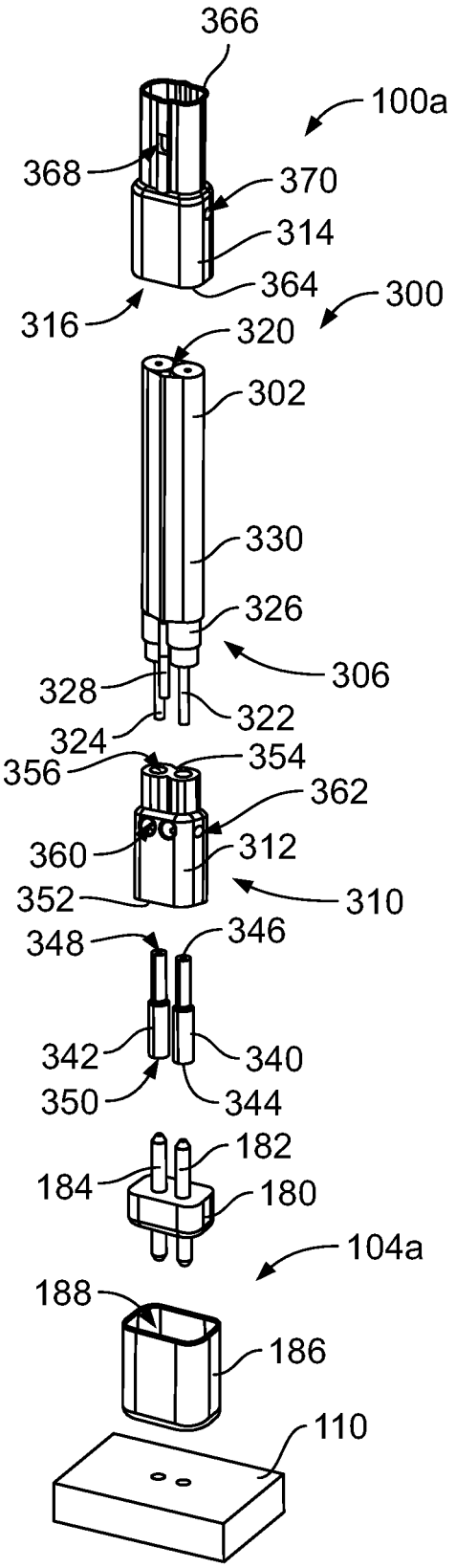
FIG. 7 is an exploded perspective view of a portion of the electrical connector system in accordance with an exemplary embodiment.

FIG. 5 is a partially exploded perspective view of a portion of the electrical connector system 100*a* in accordance with an exemplary embodiment. FIG. 6 is a cross-sectional perspective view of a portion of the electrical connector system 100*a* in accordance with an exemplary embodiment. FIG. 7 is an exploded perspective view of a portion of the electrical connector system 100*a* in accordance with an exemplary embodiment. FIGS. 5-7 illustrate a differential pair cable assembly 300 poised for mating with a mating component 104*a* coupled to a circuit board 110*a*.

The differential pair cable assembly 300 includes a differential pair cable 302 extending to an end 306. The differential pair cable assembly 300 includes a mating interface 308 at the end 306 configured to be mated with the mating electrical component 104*a*. In an exemplary embodiment, the differential pair cable assembly 300 includes a cable connector 310 at the end 306 defining the mating interface 308. The cable connector 310 is configured to be electrically connected to the mating electrical component 104*a* at a separable interface.

In an exemplary embodiment, the differential pair cable assembly 300 includes a differential pair housing 312 at the end 306 of the differential pair cable 302. The differential pair cable assembly 300 includes a differential pair shield 314 having a shield cavity 316 that receives the differential pair housing 312. The differential pair shield 314 is provided at the end 306 of the differential pair cable 302. Optionally, the differential pair shield 314 may include one or more shield contacts (not shown), such as interference bumps or deflectable spring fingers, configured to be mated to the mating electrical component 104*a*.

The differential pair cable 302 includes a twin-axial cable core 320 having a first conductor 322 and a second conductor 324. The cable core 320 includes a cable shield 326 providing electrical shielding for the first conductor 322 and the second conductor 324. The conductors 322, 324 are a differential pair configured to convey differential signals. In an exemplary embodiment, the cable core 320 includes a drain wire 328 extending along the cable shield 326. A cable jacket 330 surrounds the cable core 320. The cable jacket 330 surrounds the drain wire 328 and the cable shield 326.

In an exemplary embodiment, the differential pair cable assembly 300 includes a first contact 340 and a second contact 342. The contacts 340, 342 define a differential pair of contacts at the mating interface 308 configured to be mated with the mating electrical component 104*a*. The contacts 340, 342 each extend between a mating end 344 and a terminating end 346. The terminating end 346 is configured to be coupled to the corresponding conductor 322, 324. In the illustrated embodiment, the terminating end 346 includes a conductor bore 348 that receives the conductors 322, 324. The terminating ends 346 may be welded to the conductors 322, 324. In other various embodiments, the terminating ends 346 may be crimped to the conductors 322, 324 or terminated by other means, such as soldering, displacement connection, compliant connection, and the like. The mating end 344 is configured to be mated to the mating electrical component 104*a*. In the illustrated embodiment, the mating end 344 includes a socket 350. However, other types of mating interfaces may be provided in alternative embodiments, such as a pin, a deflectable spring beam, and the like.

With reference to FIG. 7, the differential pair housing 312 extends between a front 352 and a rear 354. The front 352 is provided at the mating interface 308. In an exemplary embodiment, the differential pair housing 312 includes channels 356 extending between the front 352 and the rear 354. The channels 356 receive contacts 340, 342 and corresponding conductors 322, 324. In various embodiments, the differential pair housing 312 includes a separator wall 358 (FIG. 6) between the channels 356. The separator wall 358 electrically isolates the contacts 340, 342 from each other. In an exemplary embodiment, the sockets 350 in the channels 356 receive the mating contacts of the mating electrical component 104*a*.

In an exemplary embodiment, the differential pair housing 312 includes laser weld windows 360 on one or more sides of the differential pair housing 312. The laser weld windows 360 are aligned with the corresponding contacts 340, 342 for laser welding the contacts 340, 342 to the corresponding conductors 322, 324. The laser weld windows 360 provide access to the contacts 340, 342 in the channels 356.

In an exemplary embodiment, the differential pair housing 312 includes retention features 362 for securing the differential pair shield 314 to the differential pair housing 312. In the illustrated embodiment, the retention features 362 are pockets formed in one or more sides of the differential pair housing 312. The pockets receive portions of the differential pair shield 314 to secure the differential pair shield 314 to the differential pair housing 312. Other types of retention features 362 may be provided in alternative embodiments.

The differential pair shield 314 extends between a front 364 and a rear 366. The shield cavity 316 extends between the front 364 and the rear 366. The shield cavity 316 is open at the front 364 and is open at the rear 366. The differential pair cable 302 extends rearward from the rear 366. The front 364 is provided at the mating interface 308 and is configured to be mated with the mating electrical component 104*a*.

In an exemplary embodiment, the differential pair shield 314 includes a laser weld window 368 on one or more sides of the differential pair shield 314. The laser weld window 368 is aligned with the drain wire 328 and/or the cable shield 326 for laser welding the differential pair shield 314 to the drain wire 328 and/or the cable shield 326.

In an exemplary embodiment, the differential pair shield 314 includes retention features 370 for securing the differential pair shield 314 to the differential pair housing 312. In the illustrated embodiment, the retention features 370 are protrusions or tabs extending from one or more sides of the differential pair shield 314. The protrusions are received in the pockets defining the retention features 362 of the differential pair housing 312. Other types of retention features 370 may be provided in alternative embodiments.

The mating electrical component 104*a* is mounted to the circuit board 110*a*. In the illustrated embodiment, the mating electrical component 104*a* is a header providing an interface for the cable connector 310 to the circuit board 110*a*. The mating electrical component 104*a* includes a connector housing 180 holding a first mating contact 182 and a second mating contact 184. In the illustrated embodiment, the first mating contact 182 and the second mating contact 184 are pin contacts. The mating electrical component 104*a* includes a connector shield 186 providing electrical shielding for the mating contacts 182, 184. In the illustrated embodiment, the connector shield 186 includes a shield cavity 188 that receives the cable connector 310. The mating contacts 182, 184 extend into the shield cavity 188. The mating contacts 182, 184 are configured to be terminated to the circuit board 110*a*. For example, the mating contacts 182, 184 include pins extending into plated vias of the circuit board 110*a*. Other types of mating contacts 182, 184 may be provided in alternative embodiments. Other types of mating electrical components may be provided in alternative embodiments.

Figure 8:
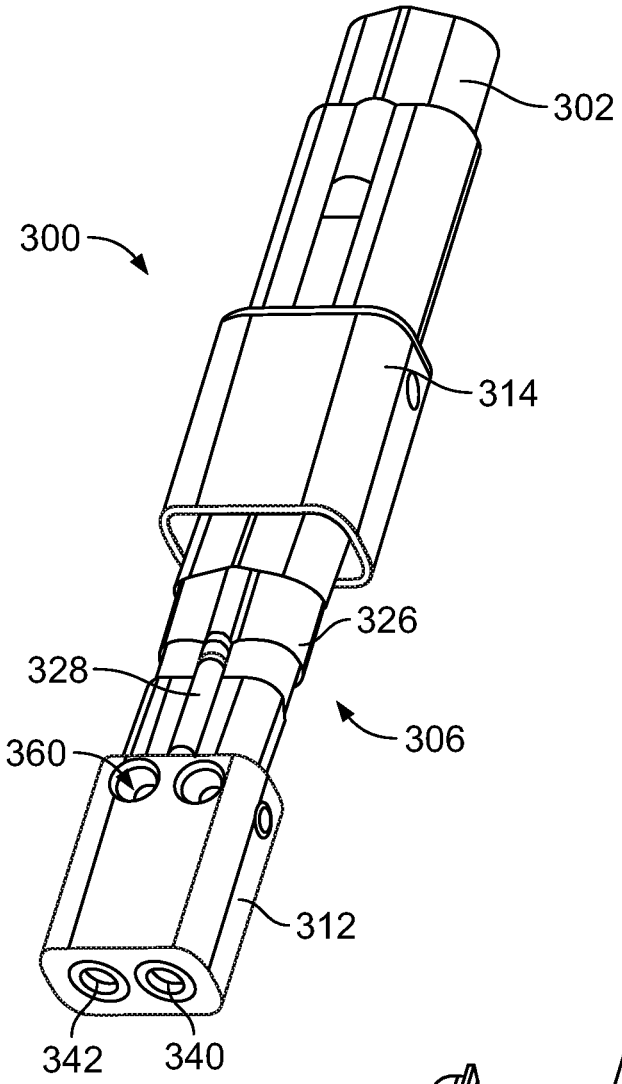
FIG. 8 is a partially exploded perspective view of a portion of the differential pair cable assembly in accordance with an exemplary embodiment.

FIG. 8 is a partially exploded perspective view of a portion of the differential pair cable assembly 300 in accordance with an exemplary embodiment. FIG. 8 illustrates the differential pair housing 312 coupled to the end 306 of the differential pair cable 302. The differential pair shield 314 is poised for loading into position on the differential pair cable 302. For example, the differential pair shield 314 may be slid down the differential pair cable 302 to cover the end 306 and the differential pair housing 312. Prior to positioning the differential pair shield 314, the contacts 340, 342 may be terminated to the conductors 322, 324 (FIG. 6). For example, the contacts 340, 342 may be welded to the conductors 322, 324 through the laser weld windows 360. Once the differential pair shield 314 is positioned on the end 306 of the differential pair cable 302, the differential pair shield 314 may be electrically coupled to the drain wire 328 and/or the cable shield 326, such as by laser welding, crimping or other termination means.

Figure 9:
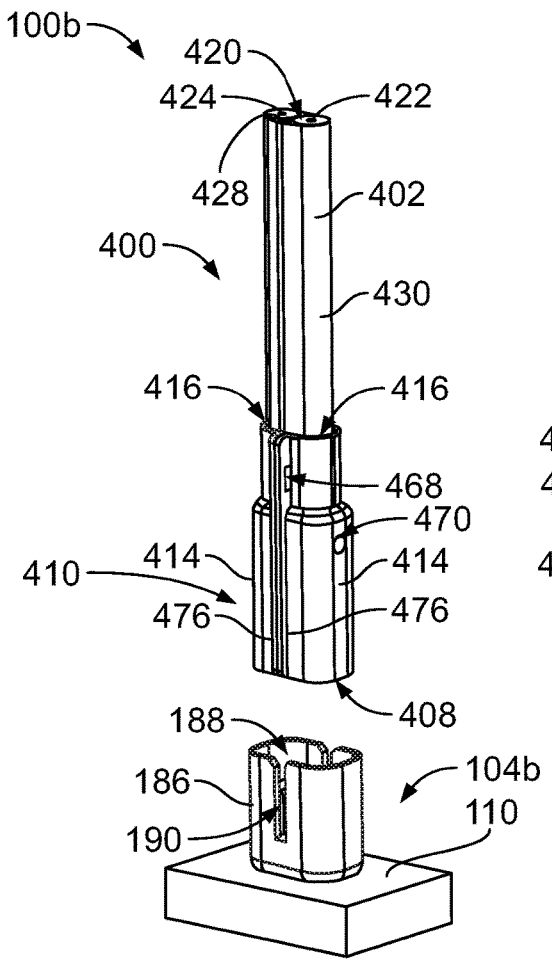
FIG. 9 is a partially exploded perspective view of a portion of the electrical connector system in accordance with an exemplary embodiment.
Figure 10:
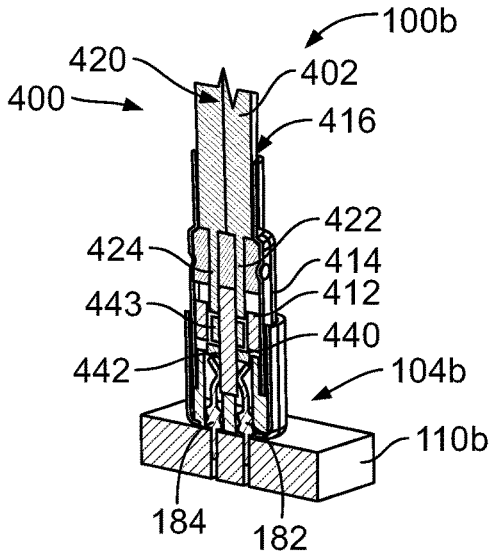
FIG. 10 is a cross-sectional perspective view of a portion of the electrical connector system in accordance with an exemplary embodiment.
Figure 11:
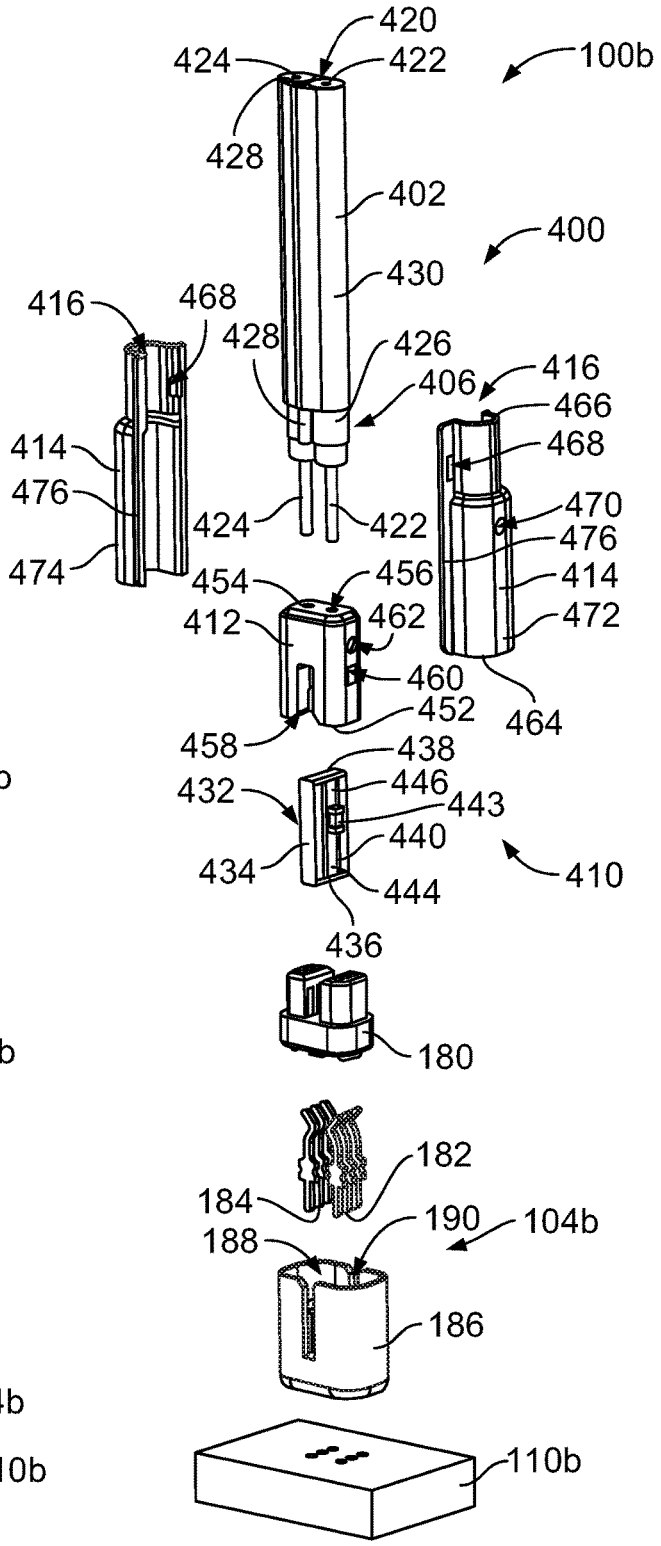
FIG. 11 is an exploded perspective view of a portion of the electrical connector system in accordance with an exemplary embodiment.

FIG. 9 is a partially exploded perspective view of a portion of the electrical connector system 100*b* in accordance with an exemplary embodiment. FIG. 10 is a cross-sectional perspective view of a portion of the electrical connector system 100*b* in accordance with an exemplary embodiment. FIG. 11 is an exploded perspective view of a portion of the electrical connector system 100*b* in accordance with an exemplary embodiment. FIGS. 9-11 illustrate a differential pair cable assembly 400 poised for mating with a mating component 104*b* coupled to a circuit board 110*b*.

The differential pair cable assembly 400 includes a differential pair cable 402 extending to an end 406 (FIG. 11). The differential pair cable assembly 400 includes a mating interface 408 at the end 406 configured to be mated with the mating electrical component 104*b*. In an exemplary embodiment, the differential pair cable assembly 400 includes a cable connector 410 at the end 406 defining the mating interface 408. The cable connector 410 is configured to be electrically connected to the mating electrical component 104*b* at a separable interface.

In an exemplary embodiment, the differential pair cable assembly 400 includes a differential pair housing 412 at the end 406 of the differential pair cable 402. The differential pair cable assembly 400 includes differential pair shields 414 having a shield cavities 416 that receive the differential pair housing 412. The differential pair shields 414 are provided at the end 406 of the differential pair cable 402. Optionally, the differential pair shield 414 may include one or more shield contacts (not shown), such as interference bumps or deflectable spring fingers, configured to be mated to the mating electrical component 104*b*.

The differential pair cable 402 includes a twin-axial cable core 420 having a first conductor 422 and a second conductor 424. The cable core 420 includes a cable shield 426 providing electrical shielding for the first conductor 422 and the second conductor 424. The conductors 422, 424 are a differential pair configured to convey differential signals. In an exemplary embodiment, the cable core 420 includes a drain wire 428 extending along the cable shield 426. A cable jacket 430 surrounds the cable core 420. The cable jacket 430 surrounds the drain wire 428 and the cable shield 426.

In an exemplary embodiment, the differential pair cable assembly 400 includes a differential pair circuit board 432 including a substrate 434 extending between a front edge 436 and a rear edge 438. The differential pair cable assembly 400 includes a first contact 440 and the second contact 442 (FIG. 10) on the differential pair circuit board 432. For example, the first and second contacts 440, 442 are defined by first and second circuit traces of the differential pair circuit board 432. The first and second contacts 440, 442 are configured to be electrically connected to corresponding mating contacts 182, 184. Optionally, the differential pair circuit board 432 includes capacitors 443 along the first and second contacts 440, 442. The contacts 440, 442 define a differential pair of contacts at the mating interface 408 configured to be mated with the mating electrical component 104*b*. The contacts 440, 442 are signal contacts. In an exemplary embodiment, the differential pair circuit board

432 additionally includes ground contacts, such as ground traces or a ground plane. The ground contacts are configured to be electrically connected to the differential pair shield 414. The ground contacts are configured to be electrically connected to corresponding mating contacts 182 or 184. The contacts 440, 442 each extend between a mating end 444 at the front edge 436 and a terminating end 446 at the rear edge 438. The terminating end 446 is configured to be coupled to the corresponding conductor 422, 424. The terminating end 446 may be soldered or welded to the conductor 422, 424. The mating end 444 is configured to be mated to the mating electrical component 104*b*. For example, the front edge 436 may be plugged into the mating electrical component 104*b*.

As shown in FIG. 11, the differential pair housing 412 extends between a front 452 and a rear 454. The front 452 is provided at the mating interface 408. In an exemplary embodiment, the differential pair housing 412 includes channels 456 that receive conductors 422, 424. In various embodiments, the differential pair housing 412 includes a board slot 458 that receives the differential pair circuit board 432. In an exemplary embodiment, the differential pair housing 412 includes a window 460 for soldering or welding the conductors 422, 424 to the terminating ends 446 of the contacts 440, 442.

In an exemplary embodiment, the differential pair housing 412 includes retention features 462 for securing the differential pair shields 414 to the differential pair housing 412. In the illustrated embodiment, the retention features 462 are pockets formed in one or more sides of the differential pair housing 412. The pockets receive portions of the differential pair shields 414 to secure the differential pair shield 414*s* to the differential pair housing 412. Other types of retention features 462 may be provided in alternative embodiments.

The differential pair shield 414 extends between a front 464 and a rear 466. The shield cavity 416 extends between the front 464 and the rear 466. Optionally, the shield cavity 416 is open at the front 464 and is open at the rear 466. The differential pair cable 402 extends rearward from the rear 466. The front 464 is provided at the mating interface 408 and is configured to be mated with the mating electrical component 104*b*.

In an exemplary embodiment, the differential pair shield 414 includes a first portion 472 and a second portion 474 configured to be coupled to the first portion 472. The first and second portions 472, 474 include joining tabs 476. The joining tabs 476 are joined together to secure the first and second portions 472, 474. For example, the joining tabs 476 may be laser welded together.

In an exemplary embodiment, the differential pair shield 414 includes a laser weld window 468 on at least one side of the differential pair shield 414. The laser weld window 468 is aligned with the drain wire 428 and/or the cable shield 426 for laser welding the differential pair shield 414 to the drain wire 428 and/or the cable shield 426.

In an exemplary embodiment, the differential pair shield 414 includes retention features 470 for securing the differential pair shield 414 to the differential pair housing 412. In the illustrated embodiment, the retention features 470 are protrusions or tabs extending from one or more sides of the differential pair shield 414. The protrusions are received in the pockets defining the retention features 462 of the differential pair housing 412. Other types of retention features 470 may be provided in alternative embodiments.

The mating electrical component 104*b* is mounted to the circuit board 110*b*. In the illustrated embodiment, the mating electrical component 104*b* is a header providing an interface for the cable connector 410 to the circuit board 110*b*. The mating electrical component 104*b* includes a connector housing 180 holding a first mating contact 182 and a second mating contact 184. In the illustrated embodiment, the first mating contact 182 and the second mating contact 184 are spring beam contacts configured to be mated to the first and second contacts 440, 442 of the differential pair circuit board 432. The mating electrical component 104*b* includes a connector shield 186 providing electrical shielding for the mating contacts 182, 184. In the illustrated embodiment, the connector shield 186 includes a shield cavity 188 that receives the cable connector 410. The mating contacts 182, 184 extend into the shield cavity 188. The mating contacts 182, 184 are configured to be terminated to the circuit board 110*b*. For example, the mating contacts 182, 184 include pins extending into plated vias of the circuit board 110*b*. Other types of mating contacts 182, 184 may be provided in alternative embodiments. Other types of mating electrical components may be provided in alternative embodiments. In an exemplary embodiment, the connector shield 186 includes slots 190 that receive the joining tabs 476.

Figure 12:
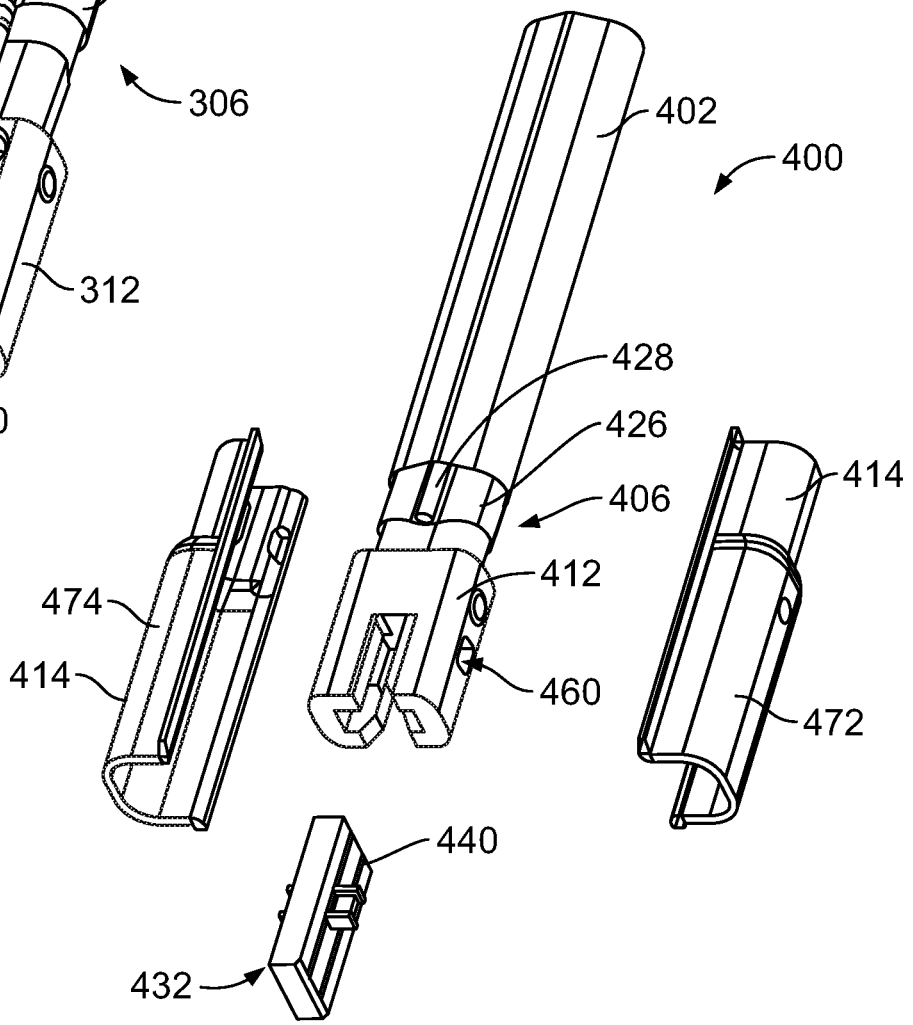
FIG. 12 is a partially exploded perspective view of a portion of the differential pair cable assembly in accordance with an exemplary embodiment.

FIG. 12 is a partially exploded perspective view of a portion of the differential pair cable assembly 400 in accordance with an exemplary embodiment. FIG. 12 illustrates the differential pair housing 412 coupled to the end 406 of the differential pair cable 402. The first and second portions 472, 474 of the differential pair shields 414 are poised for coupling to the differential pair cable 402 and the differential pair housing 412. Once the differential pair shields 414 are positioned on the end 406 of the differential pair cable 402, the differential pair shields 414 may be electrically coupled to each other and to the cable shield 426 and/or the drain wire 428, such as by laser welding, crimping or other termination means. The differential pair housing 412 includes the window 460 for soldering or welding the conductors 422, 424 of the cable 402 to the contacts 440, 442 of the differential pair circuit board 432.

Figure 13:
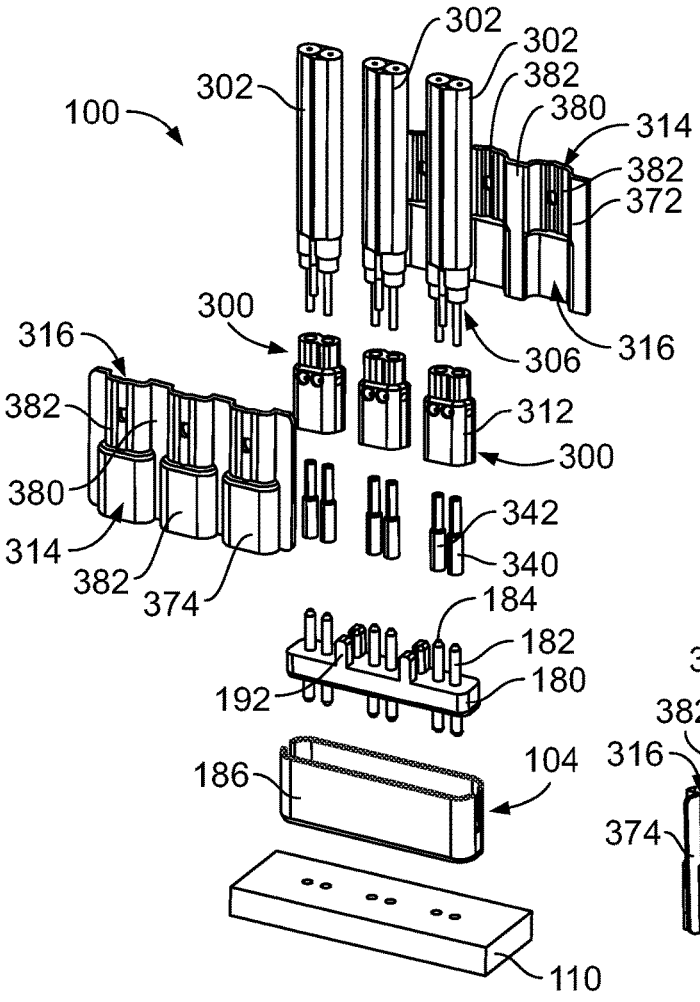
FIG. 13 is an exploded perspective view of a portion of the electrical connector system in accordance with an exemplary embodiment.
Figure 14:
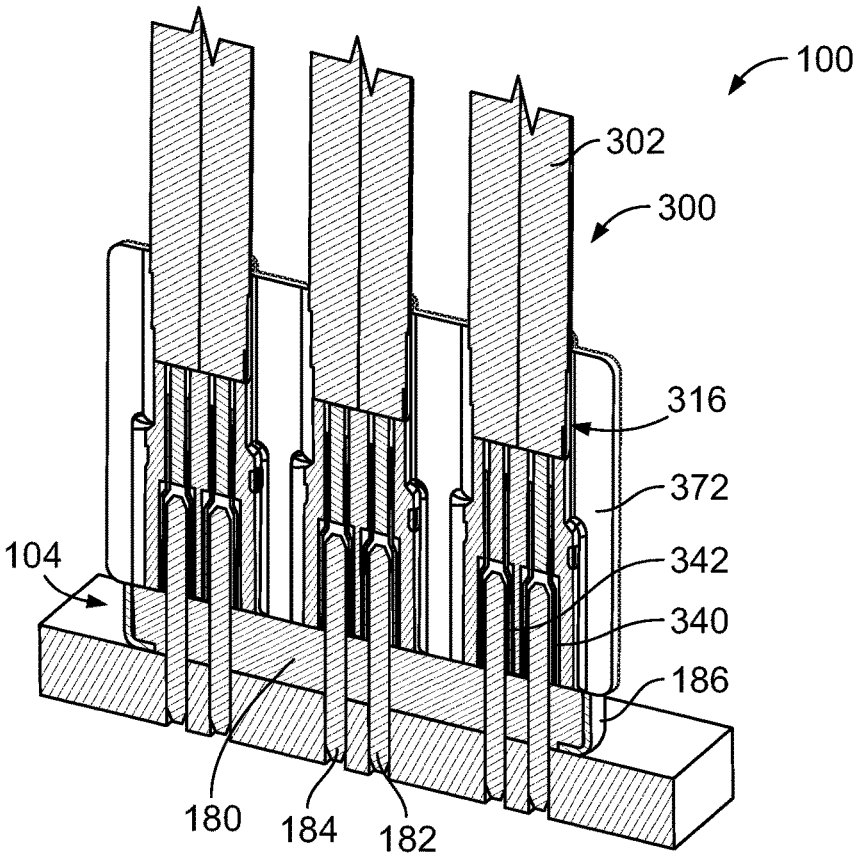
FIG. 14 is a cross-sectional perspective view of a portion of the electrical connector system in accordance with an exemplary embodiment.
Figure 15:
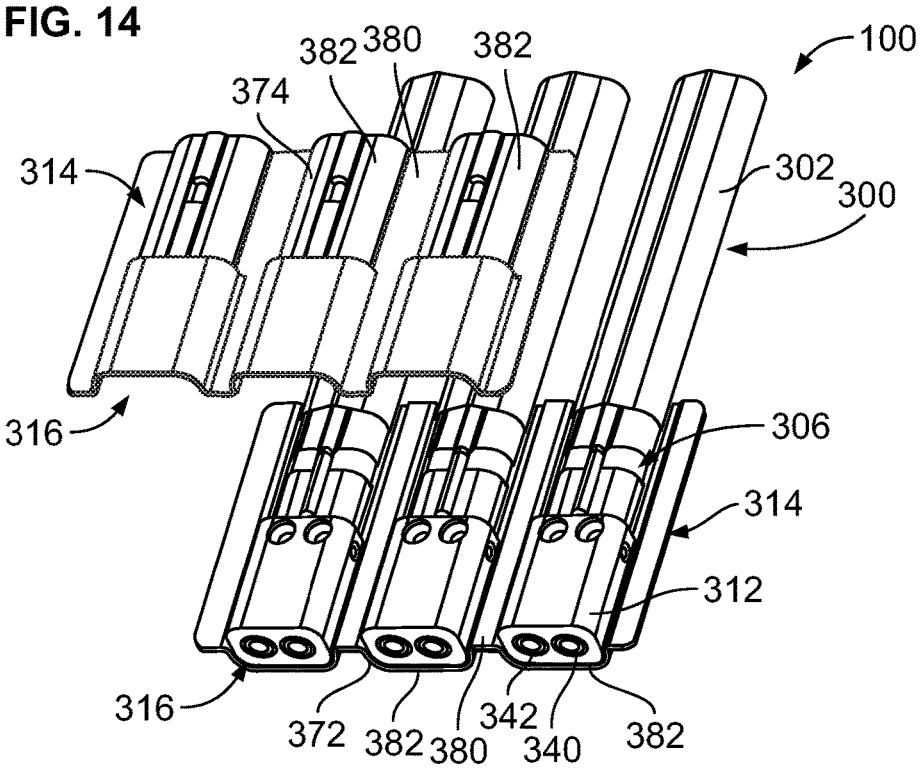
FIG. 15 is a partially exploded perspective view of a portion of the electrical connector system in accordance with an exemplary embodiment.

FIG. 13 is an exploded perspective view of a portion of the electrical connector system 100 in accordance with an exemplary embodiment. FIG. 14 is a cross-sectional perspective view of a portion of the electrical connector system 100 in accordance with an exemplary embodiment. FIG. 15 is a partially exploded perspective view of a portion of the electrical connector system 100 in accordance with an exemplary embodiment. FIGS. 13-15 show a plurality of the differential pair cable assemblies 300 configured to be clustered or ganged together as a group for mating with the mating electrical component 104. The differential pair cable assemblies 300 are arranged side-by-side with the pairs of contacts 340, 342 arranged in a single row. The mating electrical component 104 is sized and shaped to receive multiple differential pair connector assemblies 300.

Each of the differential pair connector assemblies 300 includes the differential pair housing 312 coupled to the end 306 of the corresponding differential pair cable 302. The contacts 340, 342 of each differential pair cable assembly 300 are received in the corresponding differential pair housing 312. In the illustrated embodiment, the differential pair shields 314 of the differential pair cable assemblies 300 are joined together. For example, the differential pair shields 314 are formed from a first portion 372 and a second portion 374 that are joined together, such as by laser welding. The differential pair shields 314 include intermediate portions 380 between main portions 382 that define the shield cavities 316 for the differential pair cable assemblies 300. In an exemplary embodiment, the main portions 382 and the intermediate portions 380 are integral with each other. For example, the main portions 382 and the intermediate portions 380 are stamped and formed from a single sheet of metal material to form the first and second portions 372, 374. The intermediate portions 380 of the first and second portions 372, 374 may be welded together to hold the differential pair cables 302 and the differential pair housings 312 of the differential pair cable assemblies 300 together as a unit. The mating electrical component 104 includes a single connector housing 180 holding multiple pairs of mating contacts 182, 184 separated by separating walls 192. The connector shield 186 is a single connector shield surrounding each of the pairs of mating contacts. The connector housing 180 may include a slot in the side configured to receive tabs of the connector shield 186 to locate and/or secure the differential pair shields 314 in the connector shield 186. In alternative embodiments, separate connector shields 186 and/or separate connector housings 180 may be provided.

Figure 16:
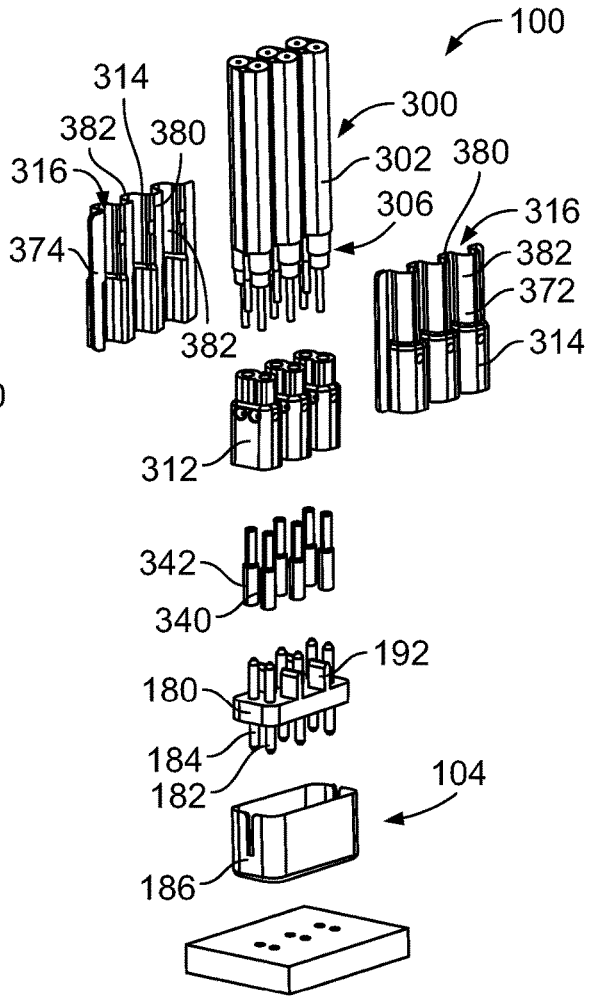
FIG. 16 is an exploded perspective view of a portion of the electrical connector system in accordance with an exemplary embodiment.
Figure 17:
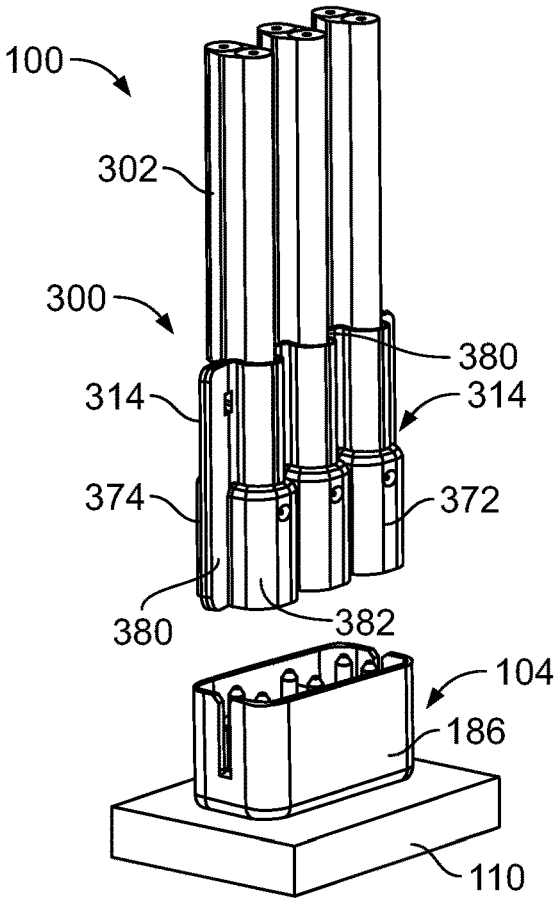
FIG. 17 is a partially exploded perspective view of a portion of the electrical connector system in accordance with an exemplary embodiment.
Figure 18:
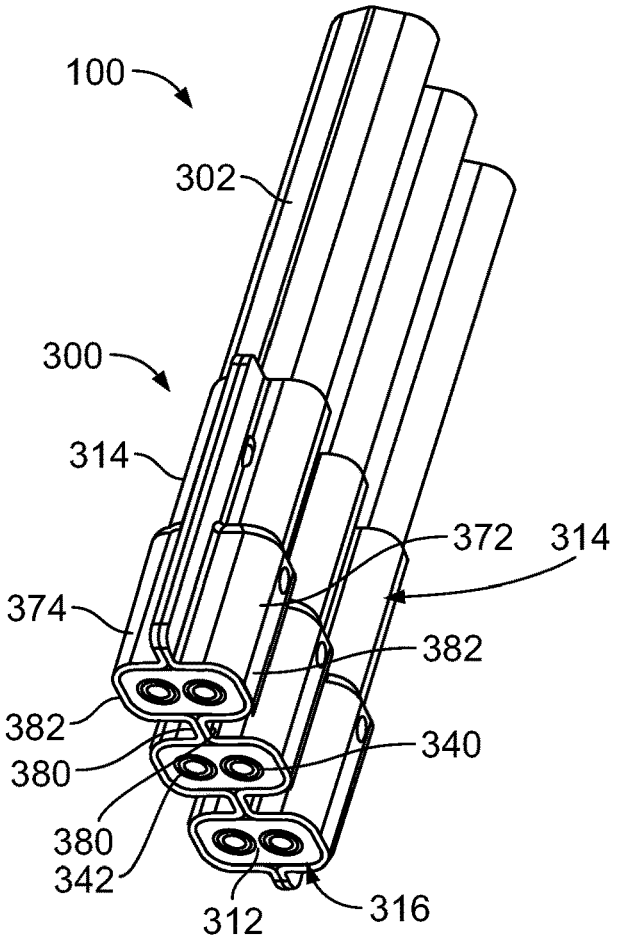
FIG. 18 is an assembled perspective view of a portion of the electrical connector system in accordance with an exemplary embodiment.
Figure 19:
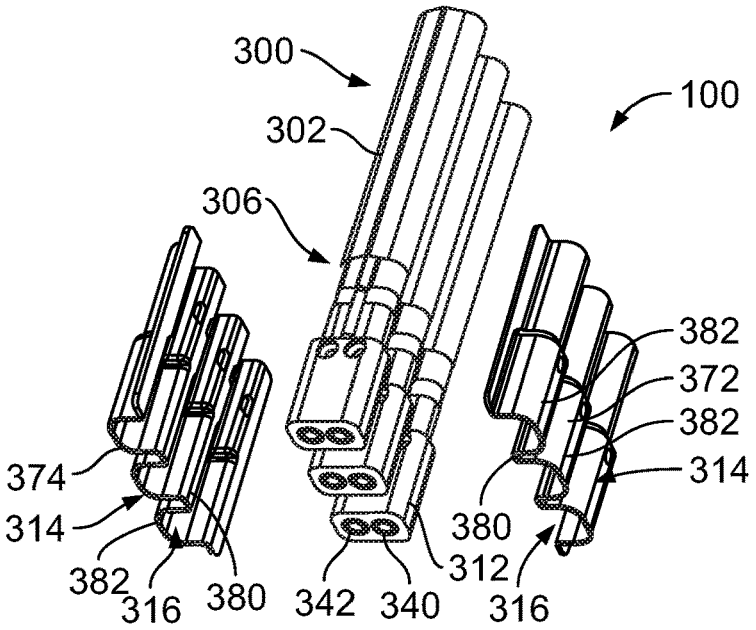
FIG. 19 is a partially exploded perspective view of a portion of the electrical connector system in accordance with an exemplary embodiment.

FIG. 16 is an exploded perspective view of a portion of the electrical connector system 100 in accordance with an exemplary embodiment. FIG. 17 is a partially exploded perspective view of a portion of the electrical connector system 100 in accordance with an exemplary embodiment. FIG. 18 is an assembled perspective view of a portion of the electrical connector system 100 in accordance with an exemplary embodiment. FIG. 19 is a partially exploded perspective view of a portion of the electrical connector system 100 in accordance with an exemplary embodiment. FIGS. 16-19 show a plurality of the differential pair cable assemblies 300 configured to be clustered or ganged together as a group for mating with the mating electrical component 104. The differential pair cable assemblies 300 are arranged stacked end-to-end with the pairs of contacts 340, 342 arranged in different rows. The mating electrical component 104 is sized and shaped to receive multiple differential pair connector assemblies 300.

Each of the differential pair connector assemblies 300 includes the differential pair housing 312 coupled to the end 306 of the corresponding differential pair cable 302. The contacts 340, 342 of each differential pair cable assembly 300 are received in the corresponding differential pair housing 312. In the illustrated embodiment, the differential pair shields 314 of the differential pair cable assemblies 300 are joined together. For example, the differential pair shields 314 are formed from the first portion 372 and the second portion 374 that are joined together, such as by laser welding. The differential pair shields 314 include the intermediate portions 380 between main portions 382 that define the shield cavities 316 for the differential pair cable assemblies 300. In an exemplary embodiment, the main portions 382 and the intermediate portions 380 are integral with each other. The intermediate portions 380 of the first and second portions 372, 374 may be welded together to hold the differential pair cables 302 and the differential pair housings 312 of the differential pair cable assemblies 300 together as a unit. The mating electrical component 104 includes a single connector housing 180 holding multiple pairs of mating contacts 182, 184 separated by separating walls 192. The connector shield 186 is a single connector shield surrounding each of the pairs of mating contacts. In alternative embodiments, separate connector shields 186 and/or separate connector housings 180 may be provided.

Figure 20:
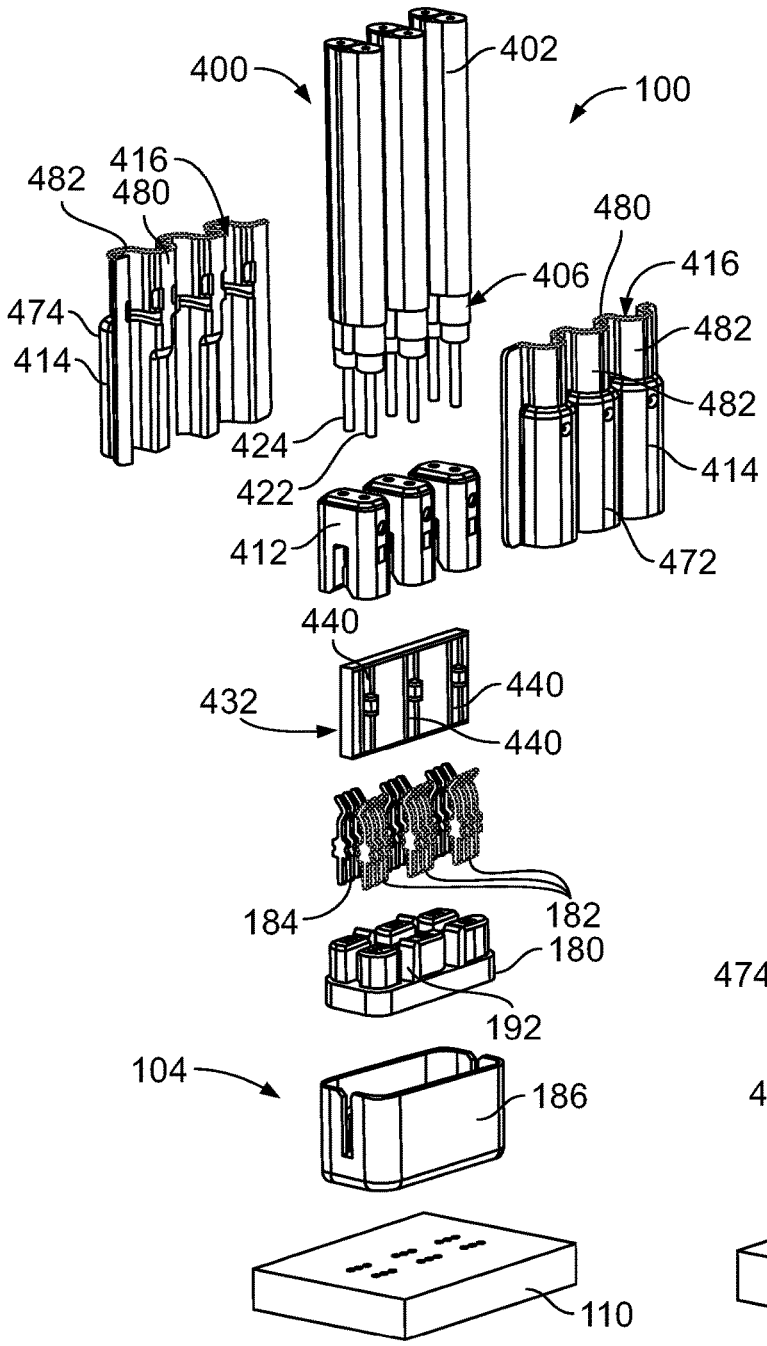
FIG. 20 is an exploded perspective view of a portion of the electrical connector system in accordance with an exemplary embodiment.
Figure 21:
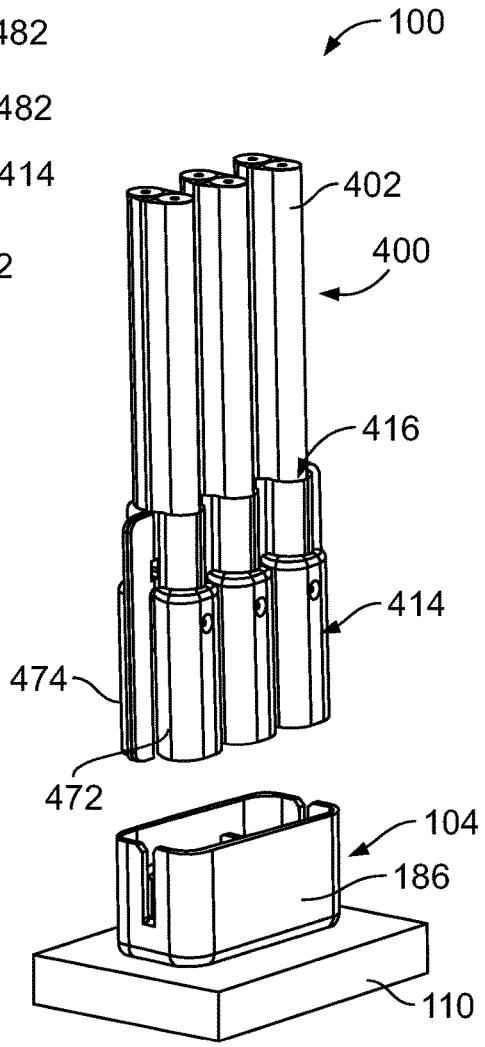
FIG. 21 is a partially exploded perspective view of a portion of the electrical connector system in accordance with an exemplary embodiment.
Figure 22:
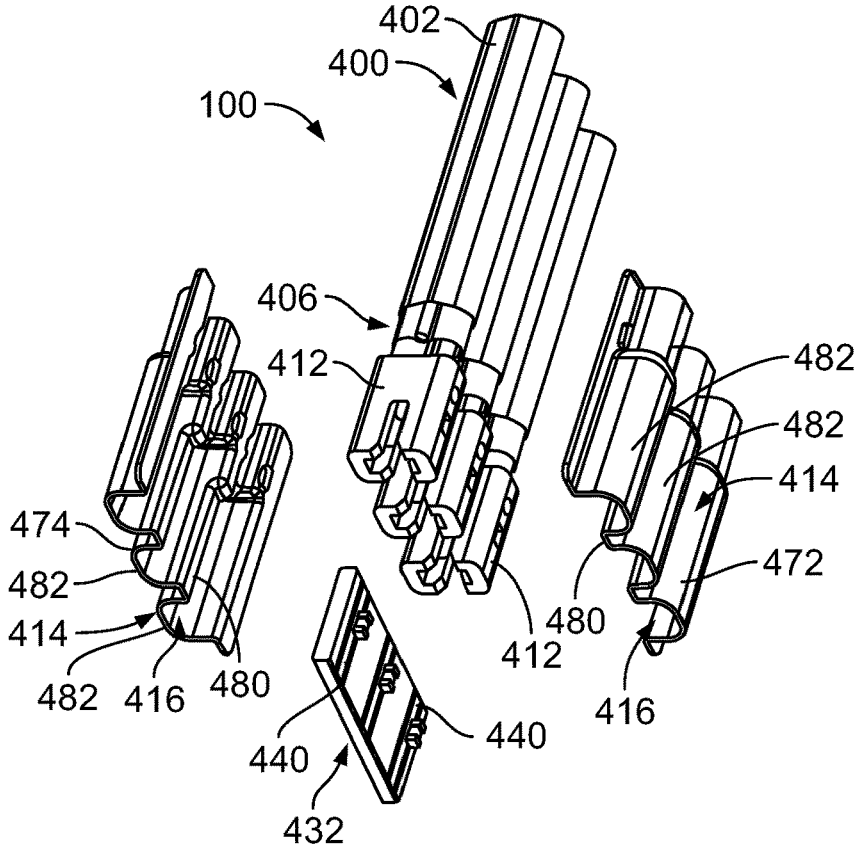
FIG. 22 is a partially exploded perspective view of a portion of the electrical connector system in accordance with an exemplary embodiment.
Figure 23:
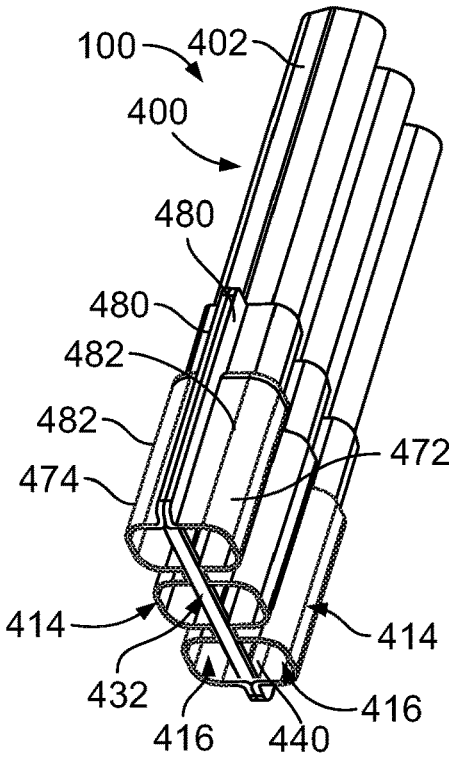
FIG. 23 is an assembled perspective view of a portion of the electrical connector system in accordance with an exemplary embodiment.

FIG. 20 is an exploded perspective view of a portion of the electrical connector system 100 in accordance with an exemplary embodiment. FIG. 21 is a partially exploded view of a portion of the electrical connector system 100 in accordance with an exemplary embodiment. FIG. 22 is an exploded perspective view of a portion of the electrical connector system 100 in accordance with an exemplary embodiment. FIG. 23 is an assembled perspective view of a portion of the electrical connector system 100 in accordance with an exemplary embodiment. FIGS. 20-23 show a plurality of the differential pair cable assemblies 400 configured to be clustered or ganged together as a group for mating with the mating electrical component 104. The differential pair cable assemblies 400 are arranged end-to-end. The mating electrical component 104 is sized and shaped to receive multiple differential pair connector assemblies 400.

Each of the differential pair connector assemblies 400 includes the differential pair housing 412 coupled to the end 406 of the corresponding differential pair cable 402. The differential pair circuit board 432 has contact 440, which may include both signal contacts and ground contacts. The differential pair circuit board 432 is received in the differential pair housings 412. In the illustrated embodiment, the differential pair shields 414 of the differential pair cable assemblies 400 are joined together. For example, the differential pair shields 414 are formed from the first portion 472 and the second portion 474 that are joined together, such as by laser welding. The differential pair shields 414 include intermediate portions 480 between main portions 482 that define the shield cavities 416 for the differential pair cable assemblies 400. In an exemplary embodiment, the main portions 482 and the intermediate portions 480 are integral with each other. For example, the main portions 482 and the intermediate portions 480 are stamped and formed from a single sheet of metal material to form the first and second portions 472, 474. The intermediate portions 480 of the first and second portions 472, 474 may be welded together or to the differential pair circuit board 432 to hold the differential pair cables 402 and the differential pair housings 412 of the differential pair cable assemblies 400 together as a unit.

During mating, the differential pair circuit board 432 is plugged into the mating electrical component 104. The mating electrical component 104 includes a single connector housing 180 holding multiple pairs of mating contacts 182, 184 separated by separating walls 192. The mating contacts 182, 184 may include signal contacts and ground contacts. The connector shield 186 is a single connector shield surrounding each of the pairs of mating contacts 182, 184. In alternative embodiments, separate connector shields 186 and/or separate connector housings 180 may be provided.

Figure 24:
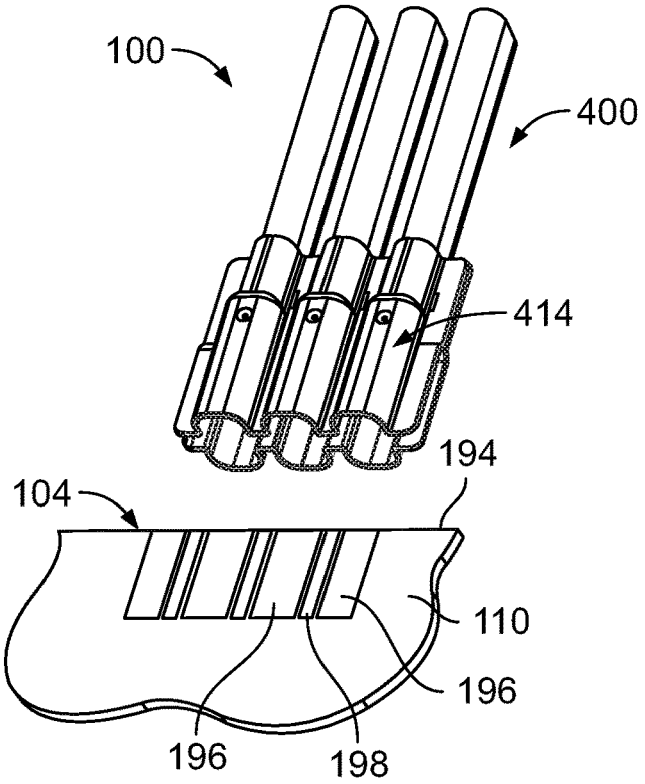
FIG. 24 is a partially exploded perspective view of the electrical connector system in accordance with an exemplary embodiment.

FIG. 24 is a partially exploded perspective view of the electrical connector system 100 in accordance with an exemplary embodiment illustrating the differential pair cable assemblies 400 poised for mating to the mating electrical component 104. In the illustrated embodiment, the mating electrical component 104 is defined by the circuit board 110. The gang of differential pair cable assemblies 400 is configured to be coupled to an edge 194 of the circuit board 110. The differential pair shield 414 is configured to be electrically connected to ground circuits 196 of the circuit board 110. The differential pair cable assemblies 400 include signal contacts configured to be electrically connected to signal circuits 198 of the circuit board 110. The signal contacts may be deflectable spring beams terminated to the conductors 422, 424 (FIG. 11). Alternatively, the conductors 422, 424 may be directly terminated to the signal circuits 198 of the circuit board 110, such as by soldering thereto.

Figure 25:
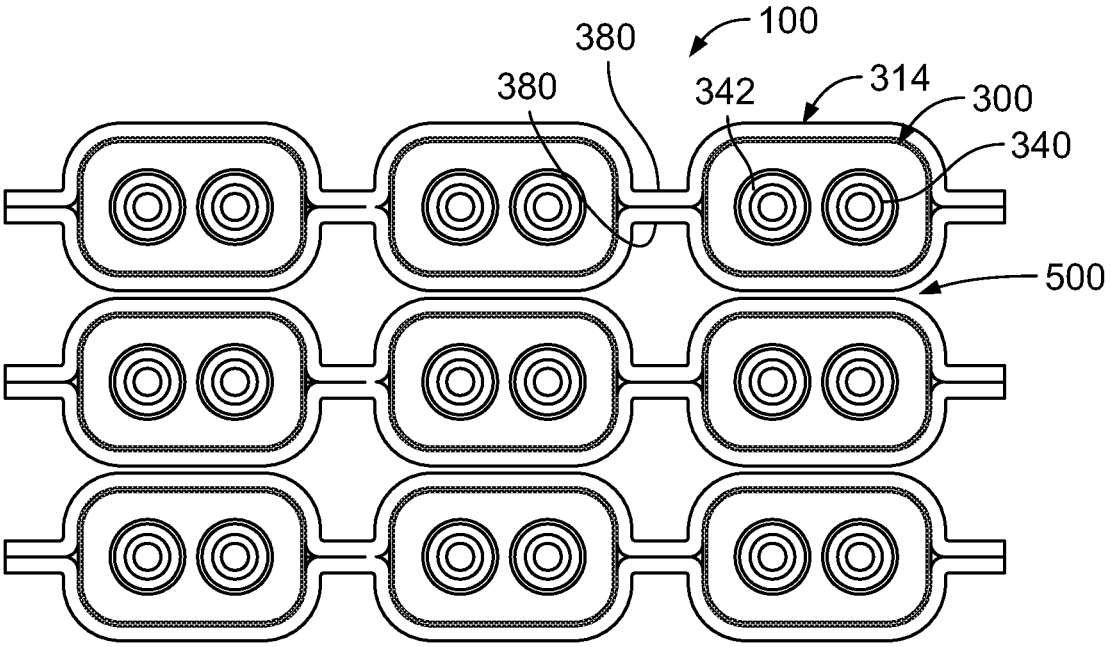
FIG. 25 is an end view of a portion of the electrical connector system in accordance with an exemplary embodiment.

FIG. 25 is an end view of a portion of the electrical connector system 100 in accordance with an exemplary embodiment showing a plurality of the differential pair cable assemblies 300 ganged together in a plurality of rows and a plurality of columns. In the illustrated embodiment, three differential pair cable assemblies 300 are provided in each row and three differential pair cable assemblies 300 are provided in each column. However, greater or fewer differential pair cable assemblies 300 may be provided in the rows and/or the columns. In the illustrated embodiment, the ganged differential pair cable assemblies 300 are provided in-row.

The differential pair cable assemblies 300 have tight spacing between the rows and the columns. For example, the spacing between the rows may be formed by a gap 500 between the differential pair shields 314. In various embodiments, the spacing may be provided without the gap 500, with the differential pair shields 314 abutting against each other. The spacing between the columns may be defined by the intermediate portions 380, which have a relatively short length allowing tight spacing of the pairs of signal contacts 340, 342.

Figure 26:
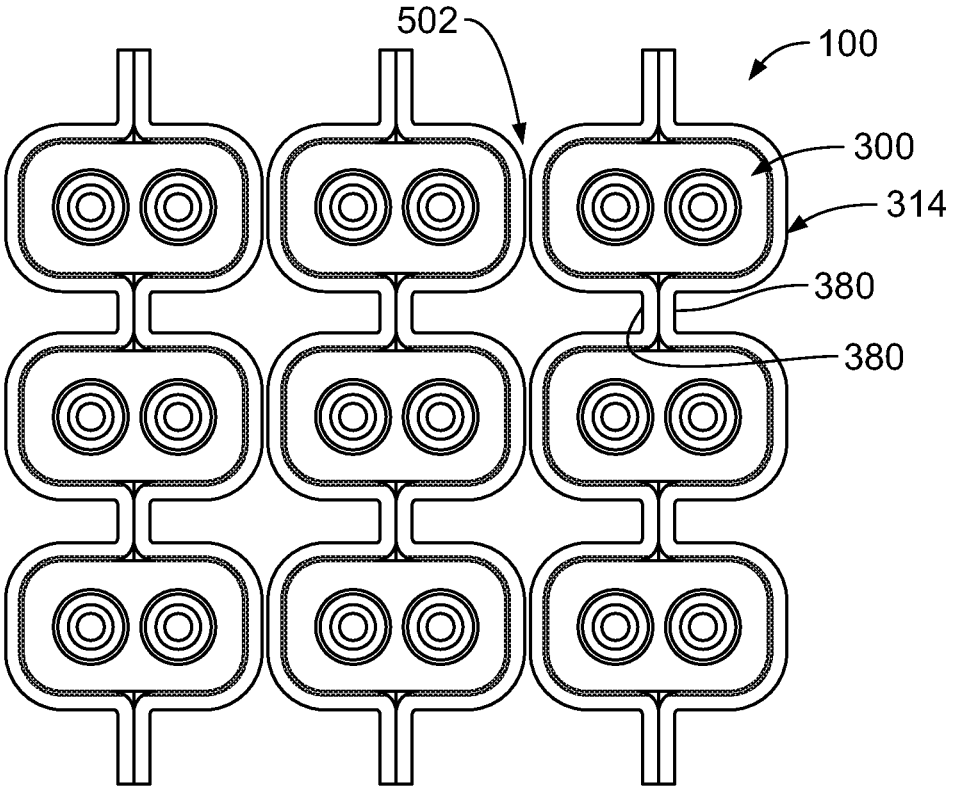
FIG. 26 is an end view of a portion of the electrical connector system in accordance with an exemplary embodiment.

FIG. 26 is an end view of a portion of the electrical connector system 100 in accordance with an exemplary embodiment showing a plurality of the differential pair cable assemblies 300 ganged together in a plurality of rows and a plurality of columns. In the illustrated embodiment, three differential pair cable assemblies 300 are provided in each row and three differential pair cable assemblies 300 are provided in each column. However, greater or fewer differential pair cable assemblies 300 may be provided in the rows and/or the columns. In the illustrated embodiment, the ganged differential pair cable assemblies 300 are provided in-column.

The differential pair cable assemblies 300 have tight spacing between the rows and the columns. For example, the spacing between the rows may be formed by the intermediate portions 380. The spacing between the columns may be defined by a gap 502 between the differential pair shields 314. In various embodiments, the spacing may be provided without the gap 502, with the differential pair shields 314 abutting against each other.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector assembly comprising:

a connector housing having a mating end configured to be mated to a mating electrical connector;

a cable contact module received in the connector housing, the cable contact module having a first mating contact and a second mating contact at the mating end for mating with the mating electrical connector; and a differential pair cable assembly extending from the cable contact module, the differential pair cable assembly comprising:

a differential pair cable having a twin axial cable core including a first conductor and a second conductor arranged within a cable jacket, the first conductor being electrically connected to the first mating contact, the second conductor being electrically connected to the second mating contact, the cable core including a cable shield providing electrical shielding for the first conductor and the second conductor, the first and second conductors being a differential pair conveying differential signals;

a first contact terminated to the first conductor opposite the first mating contact;

a second contact terminated to the second conductor opposite the second mating contact;

a differential pair housing holding the first contact and the second contact, the differential pair housing extending between a front and a rear, the differential pair housing coupled to an end of the differential pair cable; and a differential pair shield having a shield cavity, the differential pair shield extending between a front and a rear, the front of the differential pair shield provided at or forward of the front of the differential pair housing, the differential pair shield provided at or rearward of the rear of the differential pair housing, the differential pair shield surrounding the shield cavity and the front of the differential pair housing at the front and the differential pair shield surrounding the shield cavity and the rear of the differential pair housing at the rear, the differential pair shield receiving the differential pair housing in the shield cavity, the differential pair shield receiving the end of the differential pair cable and being electrically connected to the cable shield, the differential pair shield providing electrical shielding for the first contact and the second contact;

wherein the differential pair shield, the differential pair housing, the first contact, and the second contact defining a mating interface of the differential pair cable assembly spaced apart from the cable contact module and configured to be mated to a mating component.

2. The electrical connector assembly of claim 1, wherein the differential pair cable assembly is a first differential pair cable assembly, the electrical connector assembly further comprising a second differential pair cable assembly extending from the cable contact module.

3. The electrical connector assembly of claim 1, wherein the cable contact module is a first cable contact module, the electrical connector assembly further comprising a second cable contact module stacked adjacent the first cable contact module having a second differential pair cable assembly extending from the second cable contact module.

4. The electrical connector assembly of claim 1, wherein the mating interface of the differential pair cable assembly is configured to be directly mated to a mating circuit board defining the mating component.

5. The electrical connector assembly of claim 1, wherein the first contact includes a first mating end and a first terminating end, the first terminating end being terminated to the first conductor, the first mating end including a board mating interface configured to be mated directly to a mating circuit board defining the mating component, the second contact having a second mating end and a second terminating end, the second terminating end being terminated to the second conductor, the second mating end including a board mating interface configured to be mated directly to the mating circuit board.

6. The electrical connector assembly of claim 1, wherein the first contact includes a first mating end having one of a pin or a socket at the mating interface, the mating connector including the other of a pin or a socket for mating with the first mating end of the first contact, and wherein the second contact includes a second mating end having one of a pin or a socket at the mating interface, the mating connector including the other of a pin or a socket for mating with the second mating end of the second contact.

7. The electrical connector assembly of claim 1, wherein the differential pair housing includes laser weld windows aligned with the first and second contacts for laser welding the first and second contacts to the first and second conductors.

8. The electrical connector assembly of claim 1, wherein the differential pair shield includes a laser weld window aligned with the cable shield for laser welding the differential pair shield to at least one of a drain wire of the cable and the cable shield of the cable.

9. The electrical connector assembly of claim 1, wherein the differential pair shield includes a retention feature engaging the differential pair housing to axially secure the differential pair shield relative to the differential pair housing.

10. The electrical connector assembly of claim 1, wherein the differential pair shield includes a first portion having a first main portion forming part of the shield cavity and a first portion joining tab extending from the first main portion, and the differential pair shield including a second portion having a second main portion forming part of the shield cavity and a second portion joining tab extending from the second main portion, the shield cavity defined between the first portion and the second portion, the first portion joining tab being secured to the second portion joining tab to secure the first portion to the second portion around the differential pair housing.

11. The electrical connector assembly of claim 1, wherein the differential pair cable is a first differential pair cable, the differential pair housing is a first differential pair housing, and the differential pair shield is a first differential pair shield, the differential pair cable assembly further comprising:

a second differential pair cable having a twin axial cable core including a first conductor and a second conductor arranged within a cable jacket, the cable core including a cable shield providing electrical shielding for the first conductor and the second conductor of the second differential pair cable, the first and second conductors being a differential pair conveying differential signals;

a second differential pair housing holding a third contact and a fourth contact terminated to the first conductor and the second conductor of the second differential pair cable, respectively, the second differential pair housing coupled to an end of the second differential pair cable; and a second differential pair shield having a shield cavity, the second differential pair shield receiving the second differential pair housing in the shield cavity, the second differential pair shield receiving the end of the second differential pair cable and being electrically connected to the cable shield of the second differential pair cable, the second differential pair shield providing electrical shielding for the third contact and the fourth contact.

12. The electrical connector assembly of claim 11, further comprising intermediate portions between main portions of the first differential pair shield and the second differential pair shield, the intermediate portions being integral with the main portions of the first differential pair shield and the second differential pair shield to physically and electrically connect the first differential pair cable assembly and the second differential pair cable assembly.

13. The electrical connector assembly of claim 11, wherein the first differential pair shield and the second differential pair shield are overmolded by an overmolded body to secure the first differential pair cable assembly to the second differential pair cable assembly.

14. The electrical connector assembly of claim 1, further comprising a differential pair circuit board received in the differential pair housing, the differential pair circuit board including a first circuit trace defining the first contact and a second circuit trace defining the second contact.

15. The electrical connector assembly of claim 14, wherein the differential pair circuit board includes a first mating pad and a second mating pad at a mating end of the differential pair circuit board for mating with the mating component.

16. The electrical connector assembly of claim 14, further comprising a first capacitor mounted to the differential pair circuit board electrically connected to the first circuit trace and a second capacitor mounted to the differential pair circuit board electrically connected to the second circuit trace.

17. The electrical connector assembly of claim 1, wherein the differential pair housing includes a first contact channel receiving the first contact and a second contact channel receiving the second contact, the first and second contact channels open at the front of the differential pair housing and being open at the rear of the differential pair housing, the first and second contact channels being closed along sides of the first and second contact channels between the front and the rear of the differential pair housing.

18. An electrical connector assembly comprising:

a connector housing having a mating end configured to be mated to a mating electrical connector;

a board contact module received in the connector housing, the board contact module having a dielectric holder holding a first contact and a second contact, the first and second contacts having mating ends at the mating end of the connector housing for mating with the mating electrical connector, the first and second contacts having terminating ends opposite the mating ends configured to be directly terminated to a circuit board;

a cable contact module received in the connector housing and stacked with the board contact module in the connector housing, the cable contact module having a dielectric holder holding a first mating contact and a second mating contact at the mating end for mating with the mating electrical connector, wherein a mating end of the dielectric holder of the board contact module is sized and shaped identical to a mating end of the dielectric holder of the cable contact module for stacking the board contact module and the cable contact module for loading into the connector housing; and a differential pair cable assembly extending from the cable contact module, the differential pair cable assembly comprising:

a differential pair cable having a twin axial cable core including a first conductor and a second conductor arranged within a cable jacket, the first conductor being electrically connected to the first mating contact, the second conductor being electrically connected to the second mating contact, the cable core including a cable shield providing electrical shielding for the first conductor and the second conductor, the first and second conductors being a differential pair conveying differential signals;

a first contact terminated to the first conductor opposite the first mating contact;

a second contact terminated to the second conductor opposite the second mating contact;

a differential pair housing holding the first contact and the second contact, the differential pair housing coupled to an end of the differential pair cable; and a differential pair shield having a shield cavity, the differential pair shield receiving the differential pair housing in the shield cavity, the differential pair shield receiving the end of the differential pair cable and being electrically connected to the cable shield, the differential pair shield providing electrical shielding for the first contact and the second contact;

wherein the differential pair shield, the differential pair housing, the first contact, and the second contact defining a mating interface of the differential pair cable assembly spaced apart from the terminating ends of the board contact module, the mating interface being configured to be mated to a mating component.

19. The electrical connector assembly of claim 18, wherein the cable contact module and the board contact module are stacked immediately adjacent each other within the connector housing.

20. The electrical connector assembly of claim 18, wherein the cable contact module and the board contact module having identical mating interfaces at the mating end of the connector housing for mating with the mating electrical connector.

21. The electrical connector assembly of claim 18, further comprising a second cable contact module and a second board contact module arranged in the connector housing.

22. The electrical connector assembly of claim 18, wherein the differential pair housing extends between a front and a rear and the differential pair shield extends between a front and a rear, the front of the differential pair shield provided at or forward of the front of the differential pair housing, the differential pair shield provided at or rearward of the rear of the differential pair housing, the differential pair shield surrounding the shield cavity and the front of the differential pair housing at the front and the differential pair shield surrounding the shield cavity and the rear of the differential pair housing at the rear.

23. The electrical connector assembly of claim 18, wherein the differential pair housing includes a first contact channel receiving the first contact and a second contact channel receiving the second contact, the first and second contact channels open at the front of the differential pair housing and being open at the rear of the differential pair housing, the first and second contact channels being closed along sides of the first and second contact channels between the front and the rear of the differential pair housing.

* * * * *